US008146767B1

(12) United States Patent
Grant

(10) Patent No.: US 8,146,767 B1
(45) Date of Patent: Apr. 3, 2012

(54) TRASH CONTAINER

(76) Inventor: Jacqueline M. Grant, Hyattsville, MD (US)

( * ) Notice: Subject to any disclaimer, the term of this patent is extended or adjusted under 35 U.S.C. 154(b) by 746 days.

(21) Appl. No.: 12/260,505

(22) Filed: Oct. 29, 2008

(51) Int. Cl.
*B65D 43/26* (2006.01)

(52) U.S. Cl. ..... 220/263; 220/262; 220/908

(58) Field of Classification Search ..... 220/263, 220/908, 264, 262, 260; 206/264; D34/9, D34/10

See application file for complete search history.

(56) References Cited

U.S. PATENT DOCUMENTS 1,966,323 A * 7/1934 Von Elm ..... 220/263
2,246,975 A * 6/1941 Geibel ..... 220/23.87
2,475,125 A * 7/1949 Brownell ..... 220/263
2,736,454 A * 2/1956 McConnell ..... 220/23.2
2,910,206 A * 10/1959 Hodgson ..... 220/23.87
4,892,218 A 1/1990 Reiling
4,972,966 A * 11/1990 Craft, Jr. ..... 220/264
5,011,036 A 4/1991 Souza et al.
5,090,753 A 2/1992 Goodman
5,147,056 A 9/1992 Ma
D332,852 S 1/1993 Delmerico
5,531,348 A * 7/1996 Baker et al. ..... 220/264
5,897,014 A 4/1999 English
5,901,874 A 5/1999 Deters
6,010,024 A * 1/2000 Wang ..... 220/23.87
6,024,238 A 2/2000 Jaros
6,138,855 A 10/2000 Kopf
6,702,135 B2 3/2004 Picklet
6,920,994 B2 * 7/2005 Lin ..... 220/264
7,380,682 B2 * 6/2008 Lin ..... 220/263
7,607,552 B2 * 10/2009 Efstathiou ..... 220/264

* cited by examiner

*Primary Examiner* — Steven A. Reynolds

(57) ABSTRACT

The improved foot pedal mechanism for opening the lid of a typical commercial trash bin includes an additional foot pedal for sliding open the side door of the same commercial trash bin. The foot pedal lid includes a foot pedal connected to a rotating bar mechanism that is located within the housing. The opposing end of the rotating bar mechanism connects to a lifting bar, which raises and lowers a top lid of the trash bins. The foot pedal lid is designed to be located along a side of the trash bin, and not in front or on a corner. The foot pedal door uses a series of spur gears, a track, and a connecting rod as the means to open the side door.

3 Claims, 5 Drawing Sheets

TRASH CONTAINER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This invention relates to the field of commercial trash containers, more specifically, trash containers that can open with an opening mechanism.

Typical commercial trash bins are made of heavy construction and have bulky lids that open from the top upwardly. The opening of said lid requires a person to exert some muscle in order to open the lid and throw the trash away. With that in mind, there is a need for a foot pedal that will open said lid.

B. Discussion of the Prior Art

The Souza et al. Patent (U.S. Pat. No. 5,011,036) discloses a front end loading, foot operated refuse bin. However, the foot operated opening mechanism for the refuse bin disclosed under the Souza Patent utilizes a foot pedal located at a corner of the bin as opposed to a foot pedal located along the side of the bin. Moreover, the foot operated opening mechanism utilizes a leverage system as opposed to a rotating bar as the means to lift the lid on the refuse bin. Furthermore, the foot operate refuse bin of the Souza Patent does not include a sliding door pedal as an optional door opening mechanism.

The Reiling Patent (U.S. Pat. No. 4,892,218) discloses a lid control device for a refuse container. Like the Souza Patent, the lid control device of the Reiling Patent utilizes a foot pedal located at a corner of the bin of which the foot pedal operates on a leverage principal in order to raise the lid opening bar, as opposed to a rotating bar mechanism. Furthermore, the lid control device of the Reiling Patent does not include a sliding door pedal as an alternative mechanism for opening a side door of most typical commercial trash bins.

The Goodman Patent (U.S. Pat. No. 5,090,753), discloses an automatic locking mechanism for a dumpster lid wherein the securing mechanism is operated by a spring or a gravity operated foot piece. However, the automatic locking mechanism disclosed under the Goodman Patent is not directed to opening and closing a dumpster lid, but rather limited to locking said dumpster lid.

The Ma Patent (U.S. Pat. No. 5,147,056) discloses a foot actuated door opener for a trash bin. However, the foot actuated door opener disclosed under the Ma Patent utilizes a pulley system that opens a door inwardly as opposed to a rotating bar mechanism that opens a bin door outwardly. Furthermore, the actuated door opener of the Ma Patent does not include a sliding door pedal as an optional means of accessing the interior compartment of a trash bin containing a side door.

The Pickier Patent (U.S. Pat. No. 6,702,135) discloses a universal dumpster having a top lid and side wall door opening. However, the universal dumpster disclosed under the Pickler Patent does not have a foot operated pedal for opening a lid located along the top of the trash bin, nor a foot pedal for opening a side door of the trash bin.

The Kopf Patent (U.S. Pat. No. 6,138,855) discloses a lid lifting apparatus for a dumpster type refuse container. However, the lid lifting apparatus of the Kopf Patent utilizes a hand crank as opposed to a foot pedal. Furthermore, the lifting apparatus of the Kopf patent is not directed to a sliding door pedal for opening a side door of a commercial trash bin.

The Jaros Patent (U.S. Pat. No. 6,024,238) discloses a trash receptacle with a foot actuated lid damper. However, the foot actuated lid damper of the Jaros Patent requires a gas damper to slow the closing of the lid, and the foot pedal of which is located along the front of the trash bin, as opposed to a side of the trash bin. Furthermore, the lid opening mechanism operates on a principal of leverage as opposed to a rotating bar that opens the lid when rotated.

In addition to the distinguishing characteristics mentioned above, the foot actuated lid damper of the Jaros Patent does not include, in addition to the foot pedal mentioned above, a separate sliding door pedal for opening the side door of traditional commercial trash bins.

The Deters Patent (U.S. Pat. No. 5,901,874) discloses a handicapped accessible dumpster having a sliding door opening. However, the sliding door opening of the Deters Patent does not have a foot pedal mechanism for raising the top lid open or sliding the side door open.

The English Patent (U.S. Pat. No. 5,897,014) discloses a door mechanism for a dumpster type garbage receptacle. However, the door mechanism disclosed in the English Patent does not utilize a rotating bar mechanism as the mechanical means to raise the lid open. Furthermore, the door mechanism of the English Patent is not directed to sliding open a side door of a commercial trash bin.

The Delmerico Patent (U.S. Pat. No. Des. 332,852) illustrates an ornamental design for a step on waste receptacle, which does not illustrate a rotating bar as the mechanical means to lift the lid.

In light of all the above discussed prior art there is no prior art pertaining to a commercial trash bin having a foot pedal located along a side of said trash bin of which the foot pedal connects to a rotating bar that in turn rotates and opens the lid of the commercial trash bin.

SUMMARY OF THE INVENTION

The invention is an improved foot pedal mechanism for opening the lid of a typical commercial trash bin and an additional foot pedal for sliding open the side door of the same commercial trash bin. The foot pedal lid of the invention consists of a foot pedal connected to a rotating bar mechanism that is located within the housing. The opposing end of the rotating bar mechanism connects to a lifting bar, which raises and lowers a top lid of the trash bins. The foot pedal lid is designed to be located along a side of the trash bin, and not in front or on a corner. The foot pedal door of the invention uses a series of spur gears, a track, and a connecting rod as the means to open the side door.

An object of the invention is to provide an improved means of opening the lid of a commercial trash bin.

A further object of the invention is to provide an improved means of sliding open the side door of a commercial trash bin.

These together with additional objects, features and advantages of the improved trash container will be readily apparent to those of ordinary skill in the art upon reading the following detailed description of presently preferred, but nonetheless illustrative, embodiments of the improved trash container when taken in conjunction with the accompanying drawings.

In this respect, before explaining the current embodiments of the improved trash container in detail, it is to be understood that the improved trash container is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the improved trash container. It is therefore important that the claims be regarded as including such equivalent construction insofar as they do not depart from the spirit and scope of the improved trash container. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
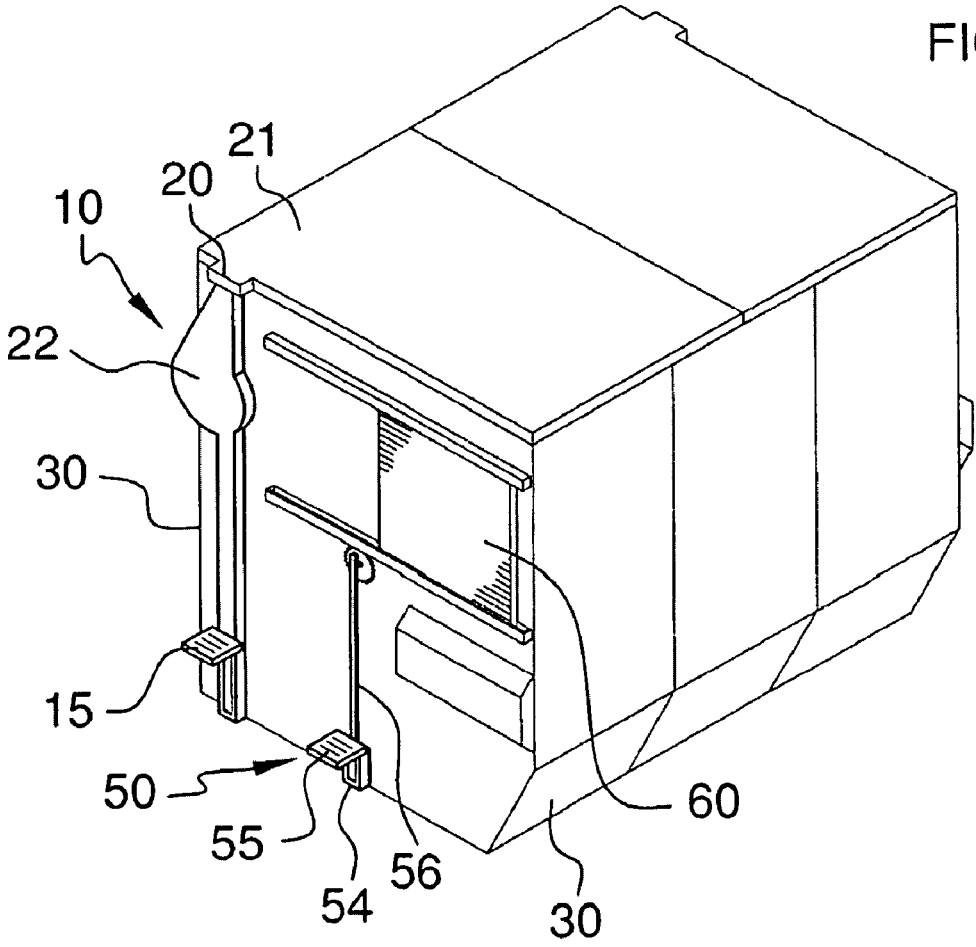
FIG. 1 illustrates an isometric view of the invention.
Figure 2:
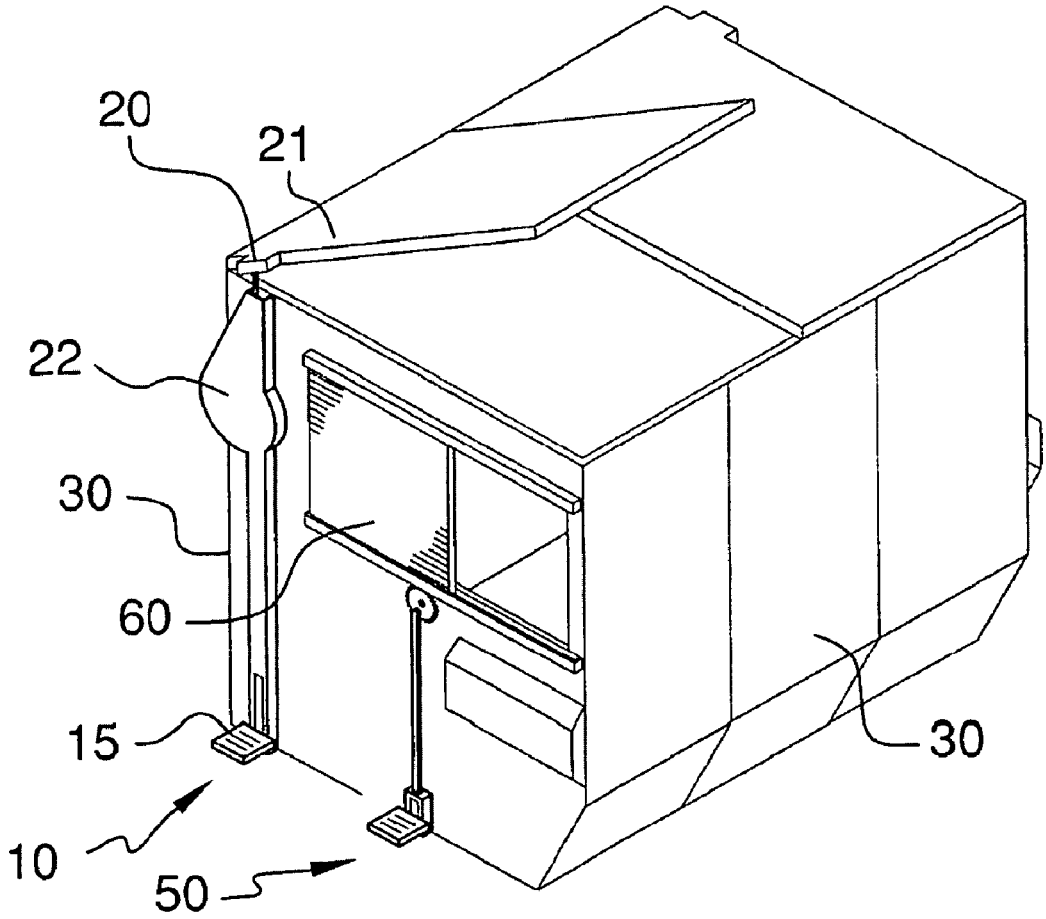
FIG. 2 illustrates an isometric view of the invention with both the top lid and the side sliding door in an open position.

Detailed reference will now be made to the preferred embodiment of the present invention, examples of which are illustrated in FIGS. 1-6. An improved trash bin foot operated lid opening mechanism 10 (invention), which includes a food pedal 15. The food pedal 15 is connected to a lower rising bar 16, which in turn is connected to a rotating bar 17. Connected to the opposite end of the rotating bar 17 is an upper rising bar 18.

The upper raising bar 18 is connected to a hinge 19, which is connected to a lid lift tab 20. The lid lift tab 20 is integrated into the design of a lid 21, and the lid lift tab 20 is designed to be used to push up the lid 21 when engaged by the invention 13.

Figure 3:
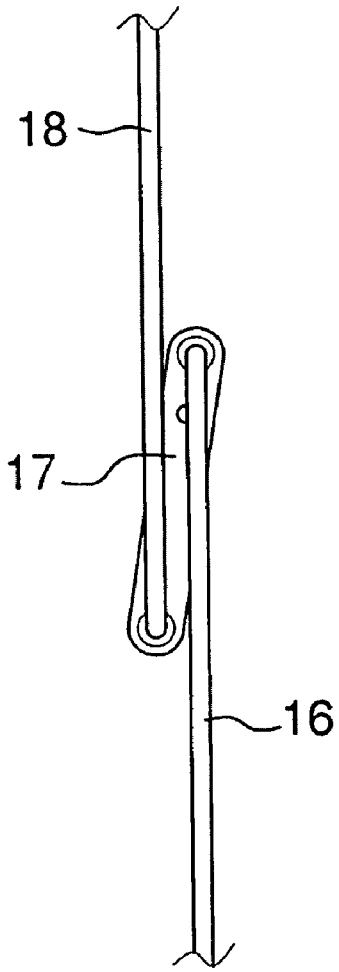
FIG. 3 illustrates the rotating bar mechanism in a retracted position.

The lower raising bar 16, rotating bar 17, and upper rising bar 18 are located within a housing 22. The housing is secured to a side of a trash bin 30, and is aligned with the lid lift tab 20 such that the hinge 19 and upper rising bar 18 are in vertical alignment with the invention 10 in a lowered position as depicted in FIGS. 1 and 3. The housing 22 is designed to protect the above mentioned bars from bending due to accidental interaction with trash to be disposed in the trash bin 30.

The housing 22 has located about midway up a circular portion with a triangular top in order to accommodate the rotational movement of the rotating bar 17 and upper rising bar 18.

Figure 4:
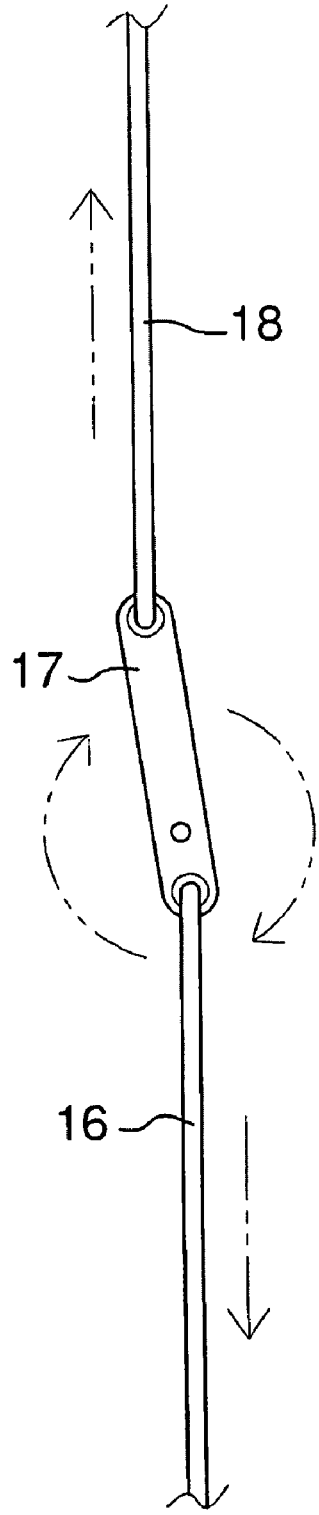
FIG. 4 illustrates the rotating bar mechanism in an extended position.
Figure 5:
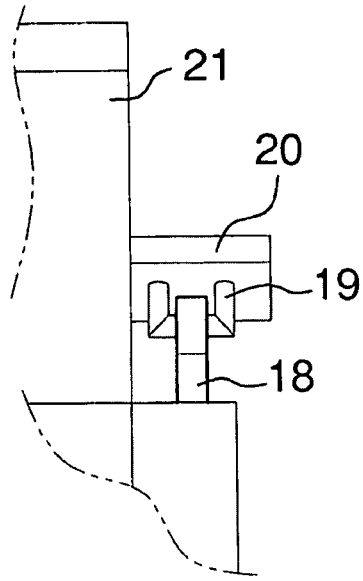
FIG. 5 illustrates a detailed view of the lifting bar and hinge connection with the lid.
Figure 6:
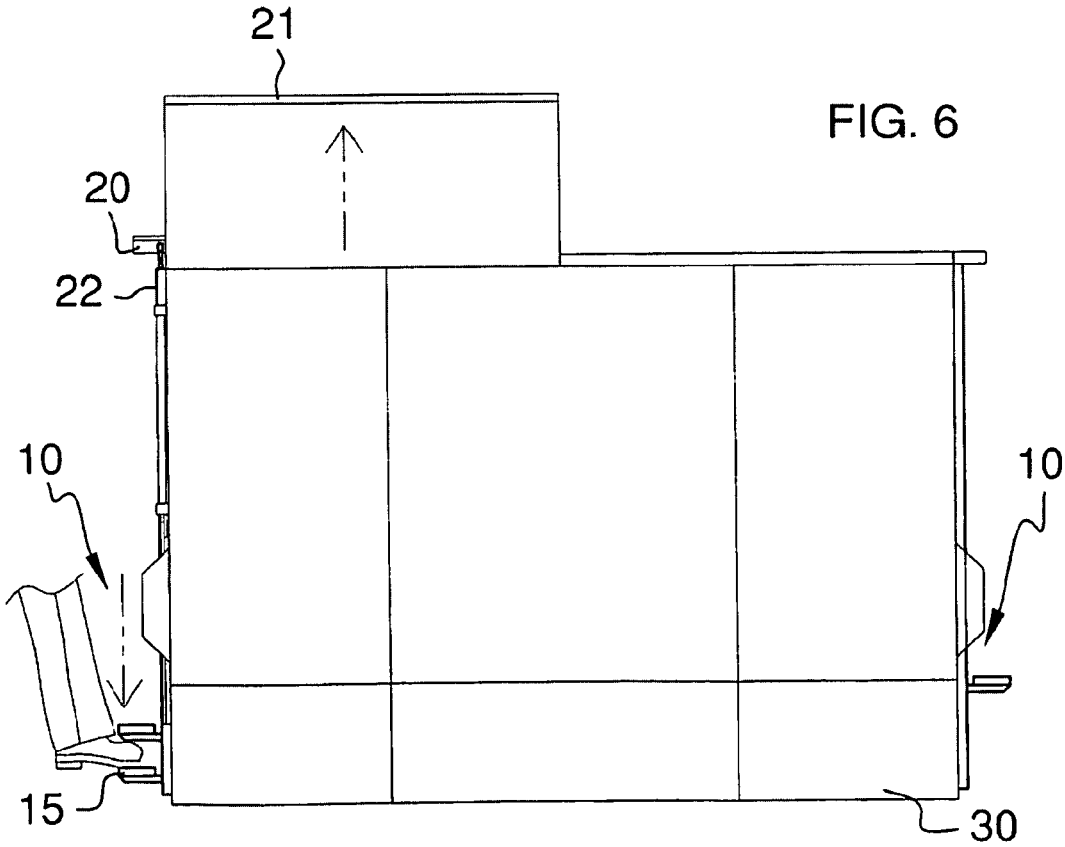
FIG. 6 illustrates a front view of the invention in use.

The invention 10 is used by simply pressing the foot pedal 15 down towards the ground, which will in turn rotate the rotating bar 17 roughly 180 degrees as depicted in FIGS. 3 and 4. When the rotating bar has rotated roughly 180 degrees, as depicted in FIG. 4, the upper rising bar 18 will have traveled upward roughly the length of the rotating bar 17.

Once the lid 21 has been raised, any trash will be disposed of inside of the trash bin 30 and the foot pedal 15 can be released and allowed to travel up in order for the lid 21 to lower back to the lowered position, as depicted in FIG. 1.

The length of the rotating bar 17 will depend on various geometric considerations such as the location of the lid lift tab 20 with respect to the hinge on the lid 21.

The lower raising bar 16, rotating bar 17, and upper rising bar 18 are made of a metal. The housing 22 is made of a durable plastic or a metal.

Figure 7:
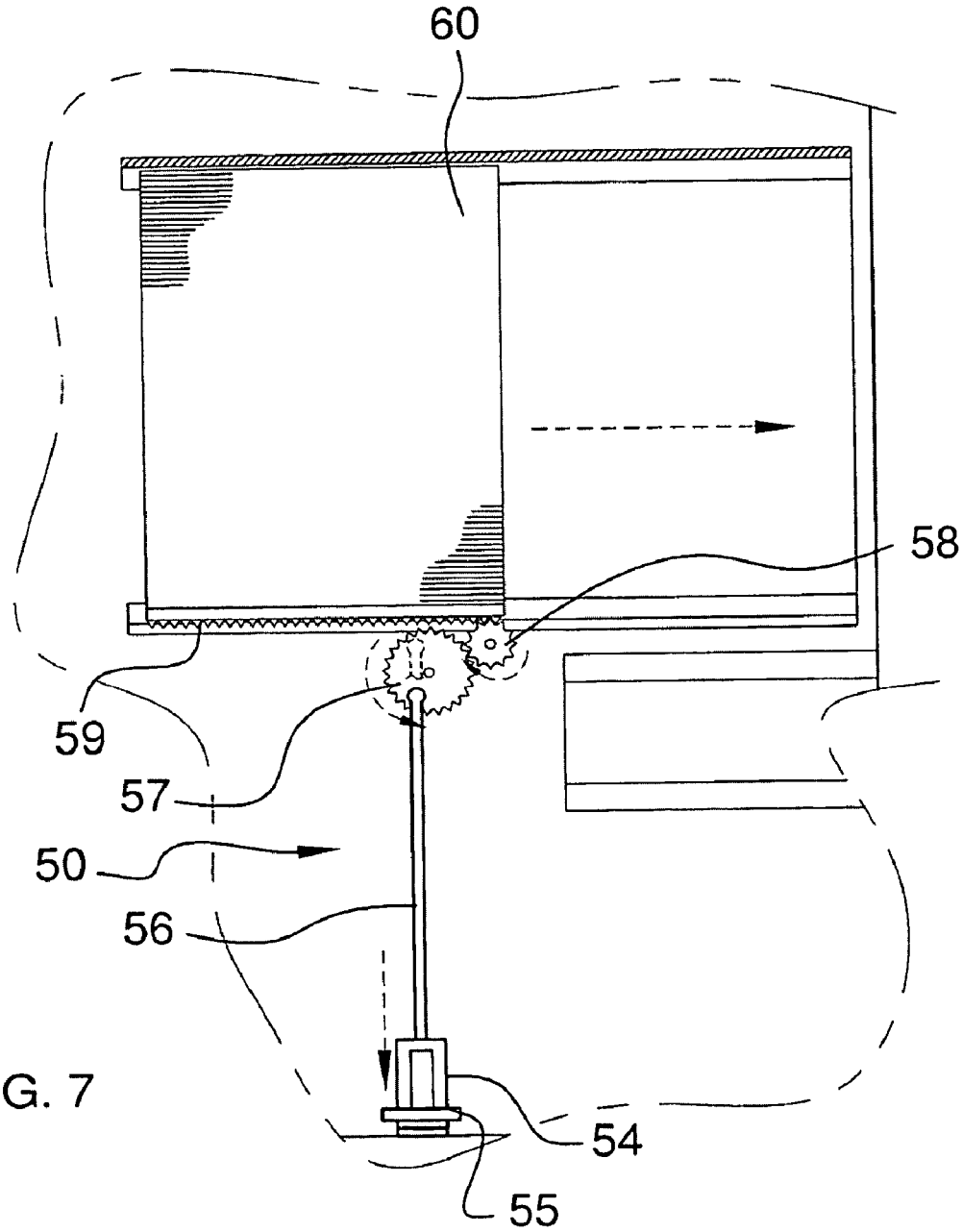
FIG. 7 illustrates a front view of the door foot pedal in use.

Referring now to FIG. 7, the second embodiment of the invention is an improved sliding door pedal 50 (hereinafter door opener), which includes a foot pedal box 54 which contains a foot pedal 55. The foot pedal box 54 is mounted along the bottom, exterior edge of the trash bin 30 in a location that is adjacent to a sliding door 60 of a trash bin 30.

The foot pedal 55 is connected to one end of a rising bar 56. Connected at the opposite end of the rising bar 56 is a first spur gear 57. The first spur gear is aligned with and touches a second spur gear 58, such that when the rising arm 56 rotates the first spur gear 57, the second spur gear 58 will have a higher rotational velocity.

It shall be noted that the mechanical advantage obtained through the use of multiple spur gears is not a required feature of the second embodiment, but merely a means to increase the overall ease in use of the second embodiment.

It shall be further noted that located within the foot pedal box 54 and underneath the foot pedal 55 is a spring (not shown), which applies a biasing force raising the foot pedal 55 to an elevated position in a normal state.

Aligned with the second spur gear 58 is a track 59. The track 59 is a linear track system that is permanently secured to a corresponding portion of the sliding door 60.

The door opener 50 is operated by depressing the foot pedal 55, which in turn raises the rising bar 56. The rising bar 56 in turn rotates the first spur gear 57, thereby rotating the second spur gear 56, which in turn moves the track 59 and the sliding door 60 simultaneously.

The foot pedal 55, the rising bar 56, the first spur gear 57, the second spur gear 58, and the track 59 shall be made from metal.

It shall be noted that both the invention 10 and the door opener 50 are capable of being designed into the trash bin 30 or may be individually added to the trash bin 30 as aftermarket products, respectively.

With respect to the above description, it is to be realized that the optimum dimensional relationship for the various components of the invention 10 and door opener 50 to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10 and door opener 50.

It shall be noted that variations and alternatives of the present embodiment including equivalent structures and structural equivalents are readily apparent to those of ordinary skill in the art upon reading present disclosure, and such variations and alternatives are incorporated in the invention unless otherwise expressly indicated in the claims.

The inventor claims:

1. An improved trash bin foot operated slide door opening mechanism comprising:

(a) a foot pedal;

wherein the foot pedal is mounted to a foot pedal box;

wherein a spring located within the foot pedal box applies a biasing force against the foot pedal so as to raise the foot pedal up in a rested state;

wherein both the foot pedal and the foot pedal box are secured along the bottom, exterior edge of a trash bin in proximity to a sliding door of the trash bin;

(b) a lowering bar;

wherein the lowering bar is secured at one end to the foot pedal;

(c) a first spur gear;

wherein the opposite end of the lowering bar is secured to a side of the first spur gear, and is capable of rotating about point;

(d) a second spur gear;

wherein the second spur gear is aligned with and touches along the teeth of the first spur gear;

(e) a track;

wherein the track is mounted along a portion of the sliding door and is in tangential relation to the second spur gear; and wherein the foot operated door opening mechanism is operated by depressing the foot pedal, which in turn lowers the bar, thereby rotating the first spur gear and thus rotating the second spur gear, and upon which both the track and the door are moved either to the left or right depending upon orientation.

2. The improved trash bin foot operated slide door opening mechanism as described in claim 1 wherein the foot pedal, the rising bar, the first spur gear, the second spur gear, and the track are made from a metal.

3. The improved trash bin foot operated slide door opening mechanism as described in claim 1 further comprising a foot operated lid opening mechanism comprising:

(a) a foot pedal;

(b) a lower raising bar;

wherein the foot pedal attaches to the bottom of the lower raising bar;

(c) a rotating bar;

wherein the top of the lower raising bar attaches to an end of the rotating bar;

(d) an upper raising bar;

wherein the bottom of the upper raising bar attaches to an opposing end of the rotating bar;

wherein the top end of the upper raising bar is attached to a hinge;

wherein the hinge is attached to a lift tab that is located on a lid; and (e) a housing;

wherein the housing covers the lower raising bar, rotating bar, and upper raising bar;

wherein the housing has a circular section with an triangular top that accommodates the rotational movement of the rotating bar and upper raising bar; and wherein the housing is securely attached along a side of the trash bin.

* * * * *